US010255766B1

(12) United States Patent
Nottke

(10) Patent No.: US 10,255,766 B1
(45) Date of Patent: Apr. 9, 2019

(54) TRADE 'N PLACE VIDEO POKER

(71) Applicant: Timothy G. Nottke, Toledo, OH (US)

(72) Inventor: Timothy G. Nottke, Toledo, OH (US)

( * ) Notice: Subject to any disclaimer, the term of this patent is extended or adjusted under 35 U.S.C. 154(b) by 768 days.

(21) Appl. No.: 14/225,385

(22) Filed: Mar. 25, 2014

Related U.S. Application Data

(60) Provisional application No. 61/804,884, filed on Mar. 25, 2013.

(51) Int. Cl.
*A63F 9/00* (2006.01)
*G07F 17/32* (2006.01)

(52) U.S. Cl.
CPC ..... *G07F 17/3293* (2013.01)

(58) Field of Classification Search
None
See application file for complete search history.

(56) References Cited

U.S. PATENT DOCUMENTS

2005/0170876 A1* 8/2005 Masci ..... G07F 17/3267 463/16
2007/0004490 A1* 1/2007 Stefan ..... G07F 17/3293 463/12
2007/0077976 A1* 4/2007 Jackson ..... G07F 17/3265 463/13
2007/0129134 A1* 6/2007 Barrie ..... G07F 17/3293 463/20
2008/0242396 A1* 10/2008 Okada ..... G07F 17/32 463/20
2014/0370953 A1* 12/2014 Singh ..... G07F 17/326 463/13
2015/0038206 A1* 2/2015 Walton ..... G07F 17/3293 463/11

* cited by examiner

*Primary Examiner* — Seng Heng Lim
(74) *Attorney, Agent, or Firm* — Donald K. Wedding

(57) ABSTRACT

A system and method for playing Trade 'N Place Poker wherein three unique poker hands are generated from the same deck of cards and populated in a matrix of three rows and five columns. The deck of cards used for this invention is a standard deck of 52 cards plus n additional trade cards which allows the player to trade any two cards current locations on the three by five matrix with each other. For this current embodiment, a poker hand is defined as a row of five cards.

3 Claims, 11 Drawing Sheets

TRADE 'N PLACE VIDEO POKER

RELATED APPLICATION

This application claims priority under 35 U.S.C 119(e) from Provisional U.S. Patent Application Ser. No. 61/804,884 filed Mar. 25, 2013.

FIELD OF INVENTION

This invention relates to a system and method for playing Trade 'N Place Poker wherein three unique poker hands are generated from the same deck of cards and populated in a matrix of three rows and five columns. The deck of cards used for this invention is a standard deck of 52 cards plus n additional trade cards which allows the player to trade any two cards current locations on the three by five matrix with each other. For this current embodiment, a poker hand is defined as a row of five cards.

THE INVENTION

This invention relates to a multiple hand card game wherein a total 15 cards from the same deck populates a three row by five column matrix thus creating three unique horizontal poker hands. If a special card in the deck, called a trade card, populates any of the spots on the three by five matrix, the player is awarded the opportunity to trade any card from one given position to any other position in the matrix. After using the trade card to trade any two card positions on the matrix, the player is then awarded two place cards from the remaining cards in the deck in which he must place onto the three by five card matrix.

If the trade card is not dealt into the initial three by five card matrix, the player is awarded three place cards, drawn one at a time from the remaining cards in the deck, in which he is required to place onto the matrix. Each place card is drawn one at a time and can be placed in any position on the matrix. When the player places a card onto the matrix, the new card from the remaining deck will cover up the existing card in the matrix. The player must use all the place cards in order to complete the game. This means the player may have to cover a less desirable with a more desirable card and vice-versa.

Once the trade and place actions of the game have been completed, the final hands will be evaluated to determine if the hands contain a winning or losing combination. The winnings and payouts are based on a pre-determined pay scale.

In other embodiments of the current game, the number of trade cards and the percentage chance that the card will be dealt to the player in the three by five matrix may be adjusted accordingly. The number of place cards may also be adjusted to give the player more cards or less cards to make the game favorable to the casino and attractive to the player. Currently, the game allows for two place cards following the dealing of a trade card. If no trade card is dealt, the player receives three place cards.

DETAILED DESCRIPTION OF THE DRAWINGS

Figure 1:
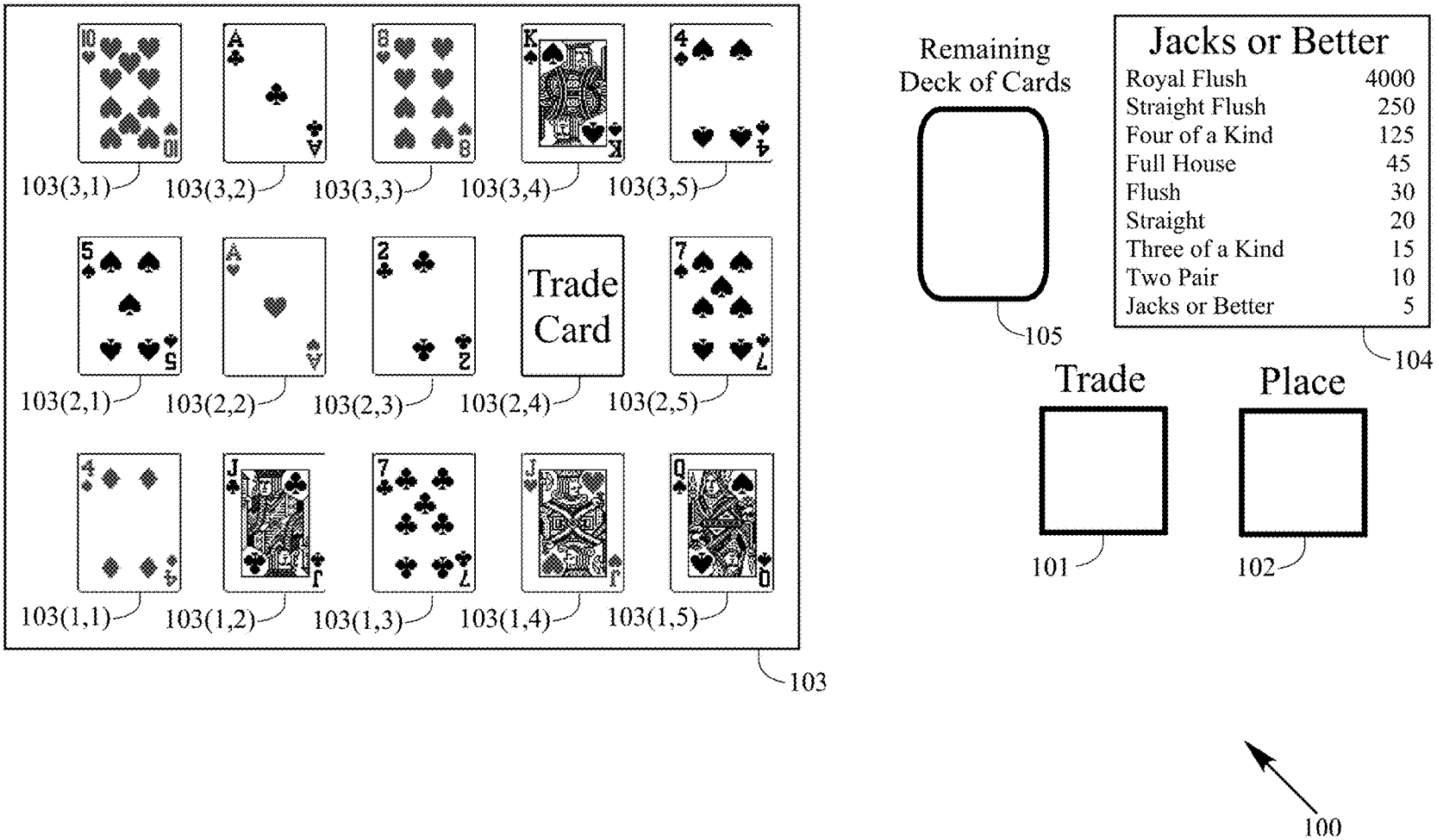
FIG. 1 shows the initial deal with the trade card dealt in the three row by five column matrix.

FIG. 1 shows the active gaming area 100, trade card box counter 101, place card box counter 102, dealt card matrix 103, predetermined pay scale 104, and the remaining deck of cards stack 105.

The opening deal shows a matrix of three rows of cards by five columns of cards for a total of 15 cards on the active gaming area 100. This arrangement allows the player to play a total of three unique horizontal poker hands. The deal for this hand shows a trade card on the active gaming area 100 which allows the player to make a trade with any two cards on the active gaming area 100. The trade card is removed from the matrix 103 and the next card in the remaining deck of cards is dealt into the spot occupied by the trade card.

Figure 1A:
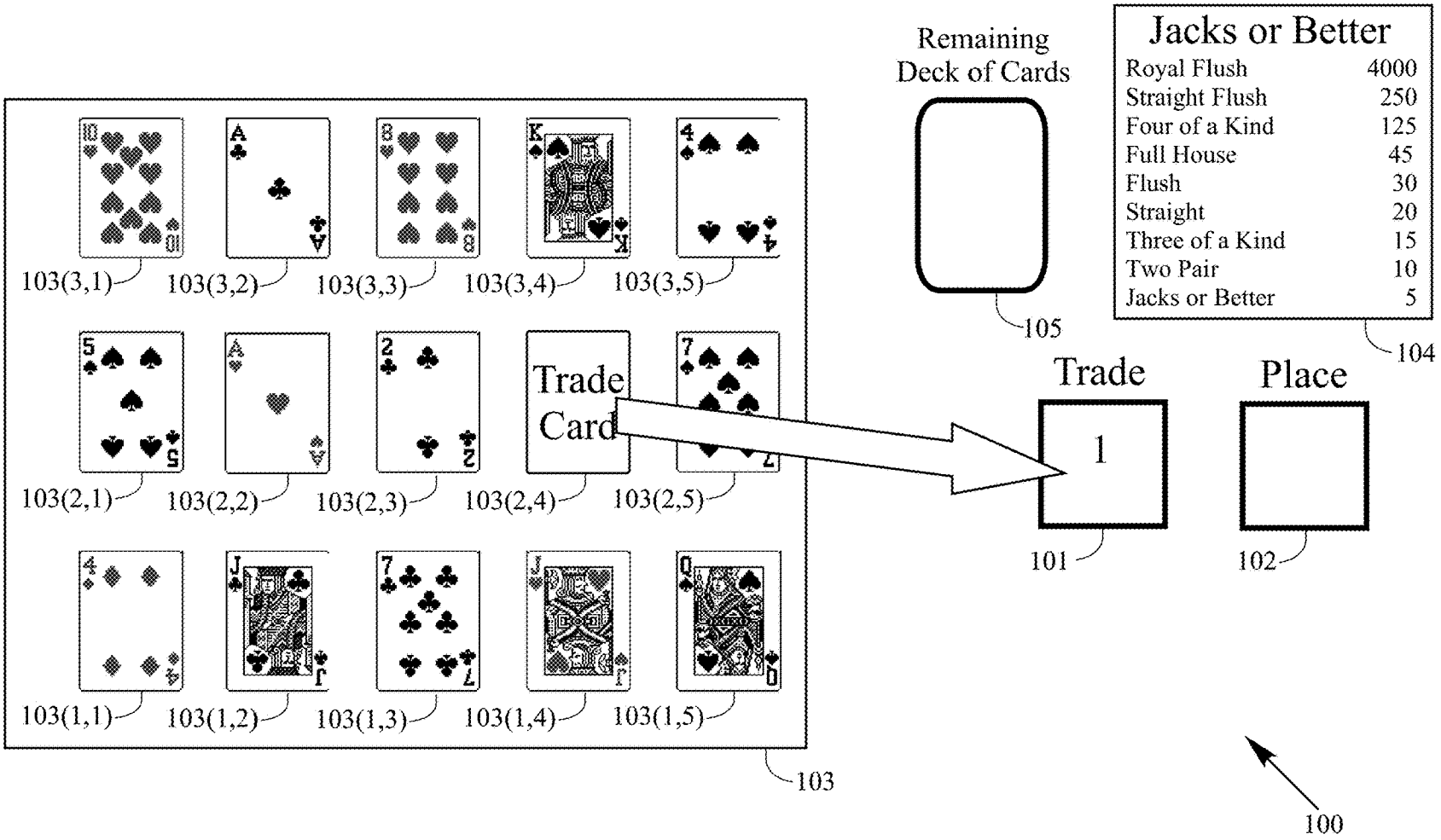
FIG. 1A shows the card being moved from the three row by five column matrix and a number one in the trade box.

FIG. 1A shows the active gaming area 100, trade card box counter 101 (now with a number one in the box due to the trade card being dealt in the matrix 103), place card box counter 102, dealt card matrix 103, predetermined pay scale 104, and the remaining deck of cards stack 105. The trade card 103(2,4) is being removed from the matrix 103 and the trade box is showing that the player has a trade that must be made on the matrix 103. A trade consists of the player picking any two cards out of the 15 total cards to trade positions with in the matrix 103. Once the trade card is removed from the matrix 103, the next card in the remaining deck of cards 105 is dealt into the spot occupied by the removal of the trade card 103(2,4) prior to the player being able to make a trade.

Figure 1B:
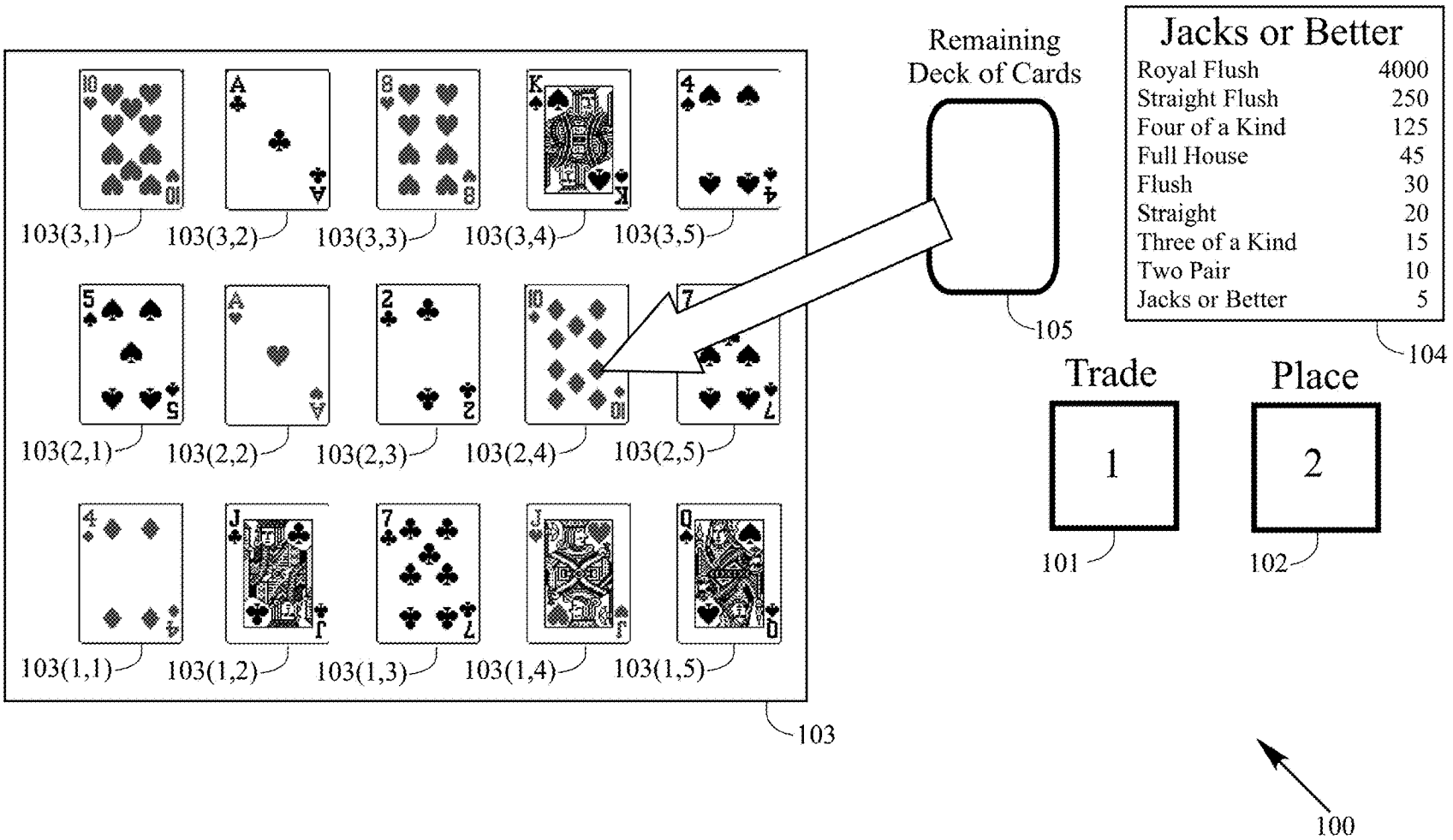
FIG. 1B shows dealing the next card from the deck, a ten of diamonds, into the three row by five column matrix and a number two in the place box.

FIG. 1B shows the active gaming area 100, trade card box counter 101 (now with a number one in the box due to the trade card being dealt in the matrix 103), place card box counter 102 (now with a number two in the box to signify that the player will get two place cards once the trade of two cards on the matrix 103 is executed), dealt card matrix 103, predetermined pay scale 104, and the remaining deck of cards stack 105. The next card from the remaining deck of cards 105 is the ten of diamonds 103 (2,4) which occupies the place that was previously held by the trade card prior to its removal from the matrix 103. FIG. 1B shows the beginning of game play when the trade card was dealt into the matrix 103. The player will now have one trade to make. Upon completion of the trade, the player will have one card from the remaining deck of cards exposed in which he will have to place in any position on the three row by five column matrix 103. The place card will take the spot occupied by the chosen card from the matrix 103, thus "removing or covering up the existing card from the game" and preventing it from being used in the final outcome of the game. Upon completion of the first placement of the card from the remaining deck of cards, the player will then get one last card from the remaining deck of cards in which he will also need to place on the three row by five column matrix 103. The placement of the second place card after a trade card is dealt, signifies the final creation of three unique poker hands and the end of the game.

Figure 2:
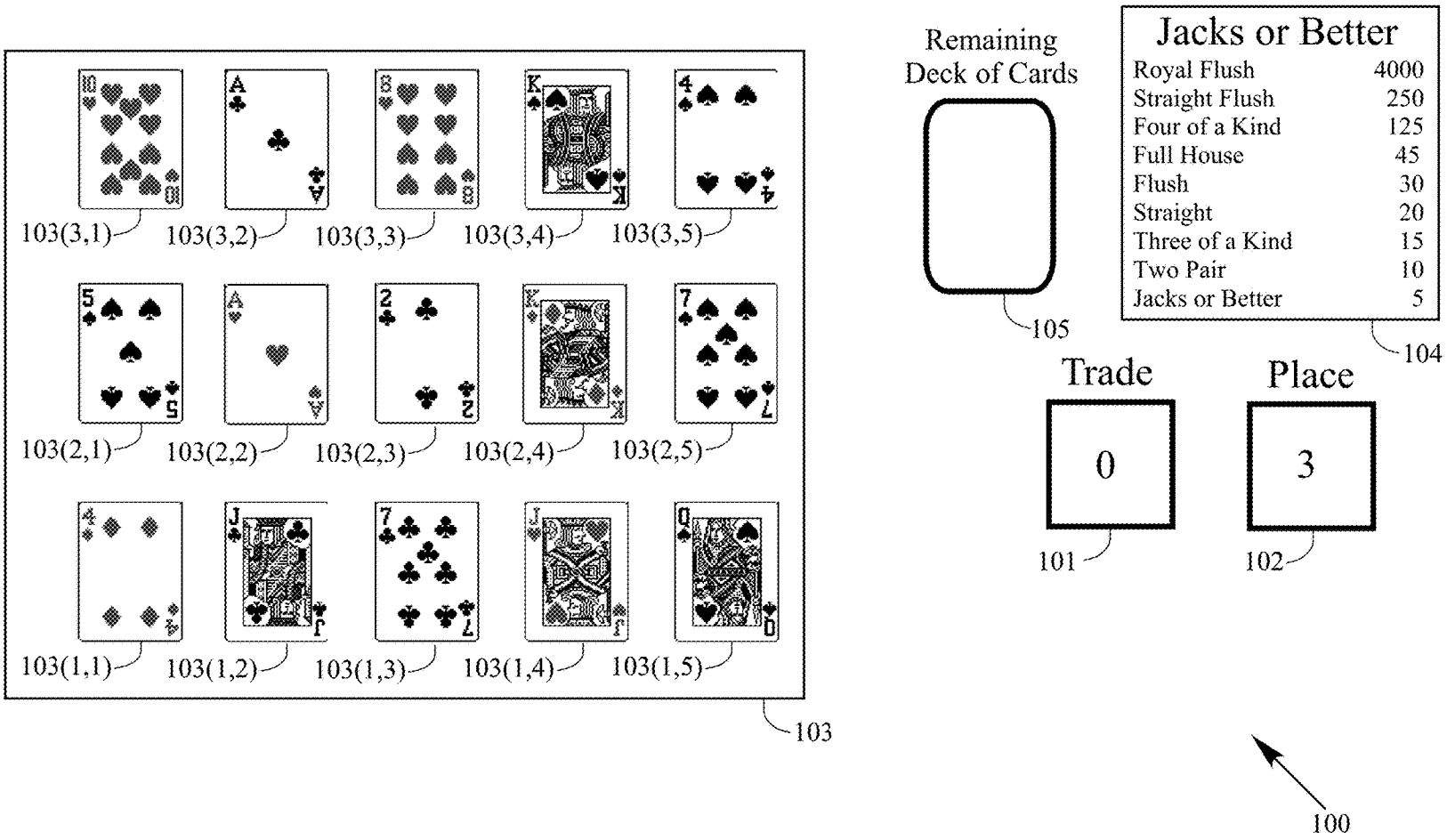
FIG. 2 shows an initial deal with no trade card dealt in the three row by five column matrix and a number three in the place box.

FIG. 2 shows the active gaming area 100, trade card box counter 101 (now with a number zero in the box due to the trade card not being dealt in the matrix 103), place card box counter 102 (now with a number three in the box to signify that the player will get three place cards to position onto the matrix 103), dealt card matrix 103, predetermined pay scale 104, and the remaining deck of cards stack 105. FIG. 2 shows the beginning of game play when the trade card was not dealt into the matrix 103. Since the trade card was not dealt into the matrix 103, the player will not get to trade cards; only place a total of three cards from the remaining deck of cards onto the matrix 103. The player places one card at a time onto the matrix 103 until all three place cards are added to the matrix 103. The place card will take the spot occupied by the chosen card from the matrix 103, thus "removing or covering up the existing card from the game" and preventing it from being used in the final outcome of the game. Upon completion of the first placement of the card from the remaining deck of cards, the player will then get a second card from the remaining deck of cards in which he will also need to place on the three row by five column matrix. After the second card is placed on the three row by five column matrix, a third and final card, is exposed from the remaining deck of cards in which the player will place on the matrix 103. The placement of the third place card signifies the final creation of three unique poker hands and the end of the game.

Figure 3:
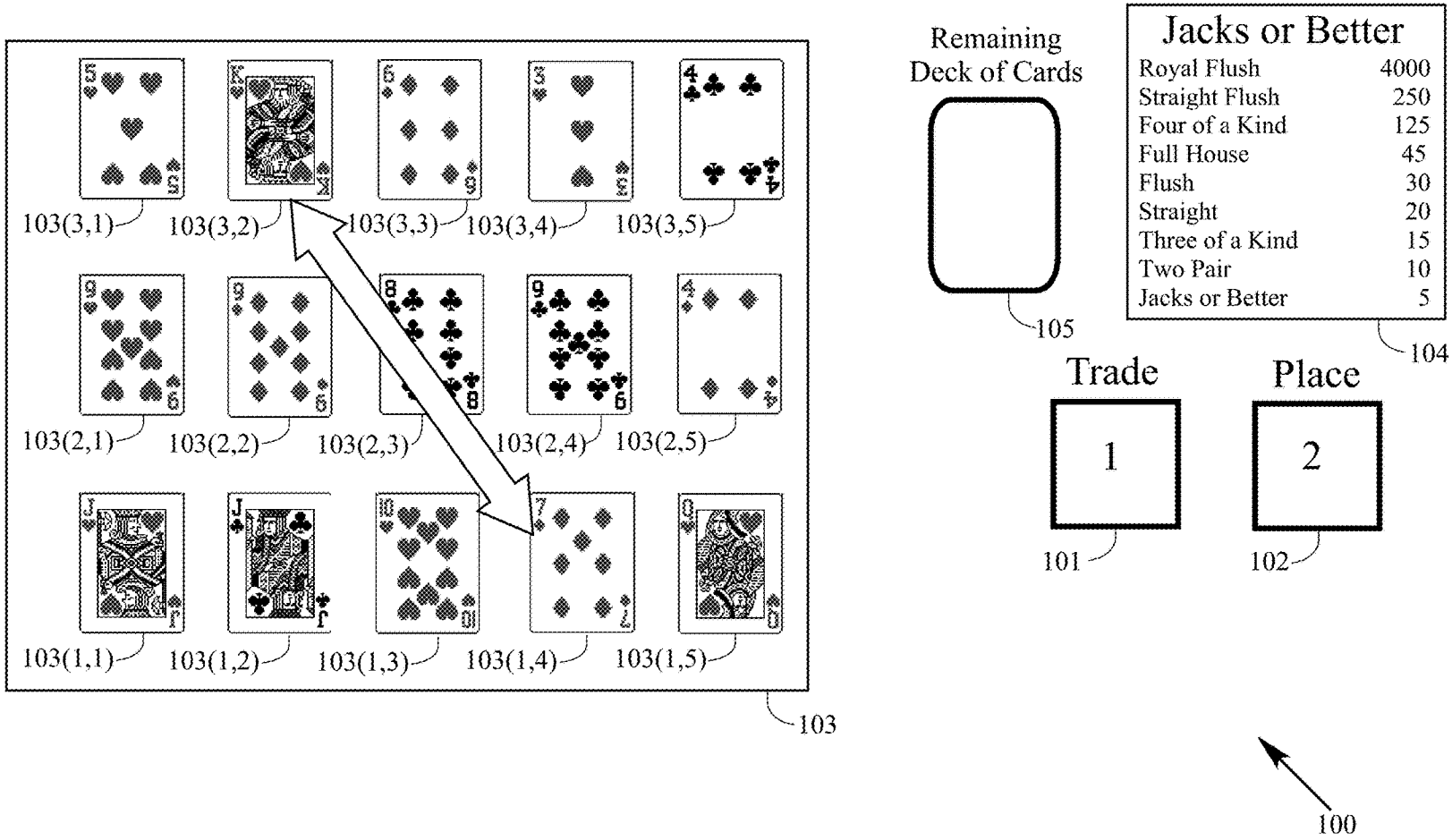
FIG. 3 shows the player trading the position of the king of hearts with the position occupied by the seven of diamonds prior to beginning the placement of the two place cards.

FIG. 3 shows the active gaming area 100, trade card counter 101 (currently with a number one in the box due to the trade card being dealt in the matrix 103), place card box counter 102 (currently with a number two in the box to signify that the player will get two place cards once the trade of two cards on the matrix 103 is executed), dealt card matrix 103, predetermined pay scale 104, and the remaining deck of cards stack 105. FIG. 3 shows a player executing the first move of the game by trading the king of hearts 103(3,2) with the seven of diamonds 103(1,4). In this embodiment the trade must always take place prior to the placement of any cards. The player has the option of trading any two cards in the matrix 103. The player may trade card positions to create a winning hand, to setup a hand to be a potential winning hand, or to protect or maintain a desired hand.

Figure 3A:
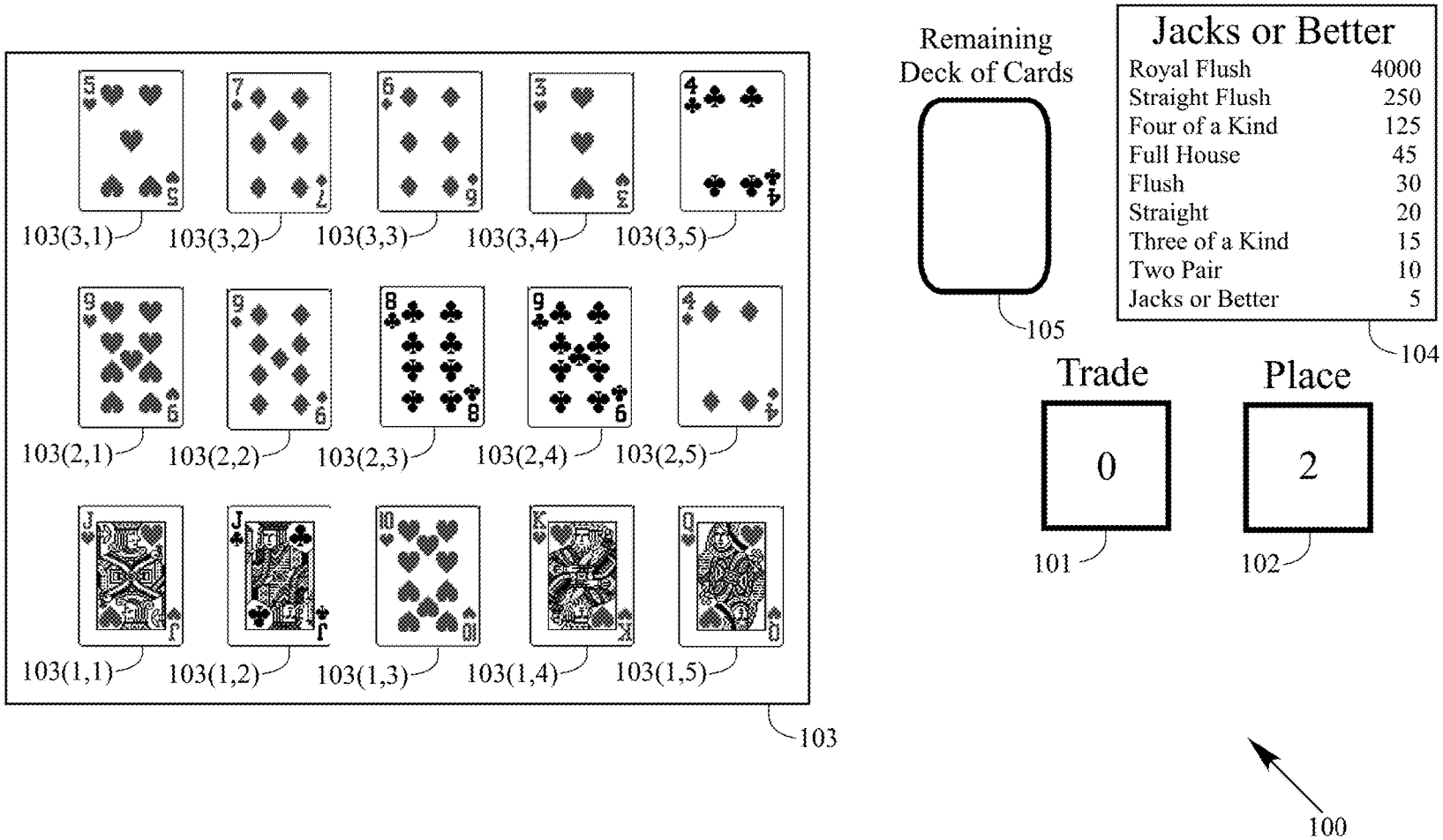
FIG. 3A shows the three row by five column matrix after the player has executed the trade of the king of hearts and the seven of diamonds.

FIG. 3A shows the active gaming area 100, trade card counter 101 (currently with a number zero in the box following the trade of king of hearts and the seven of diamonds as shown in FIG. 3.), place card box counter 102 (currently with a number two in the box to signify that the player will now get two place cards to place on the matrix 103), dealt card matrix 103, predetermined pay scale 104, and the remaining deck of cards stack 105.

Figure 3B:
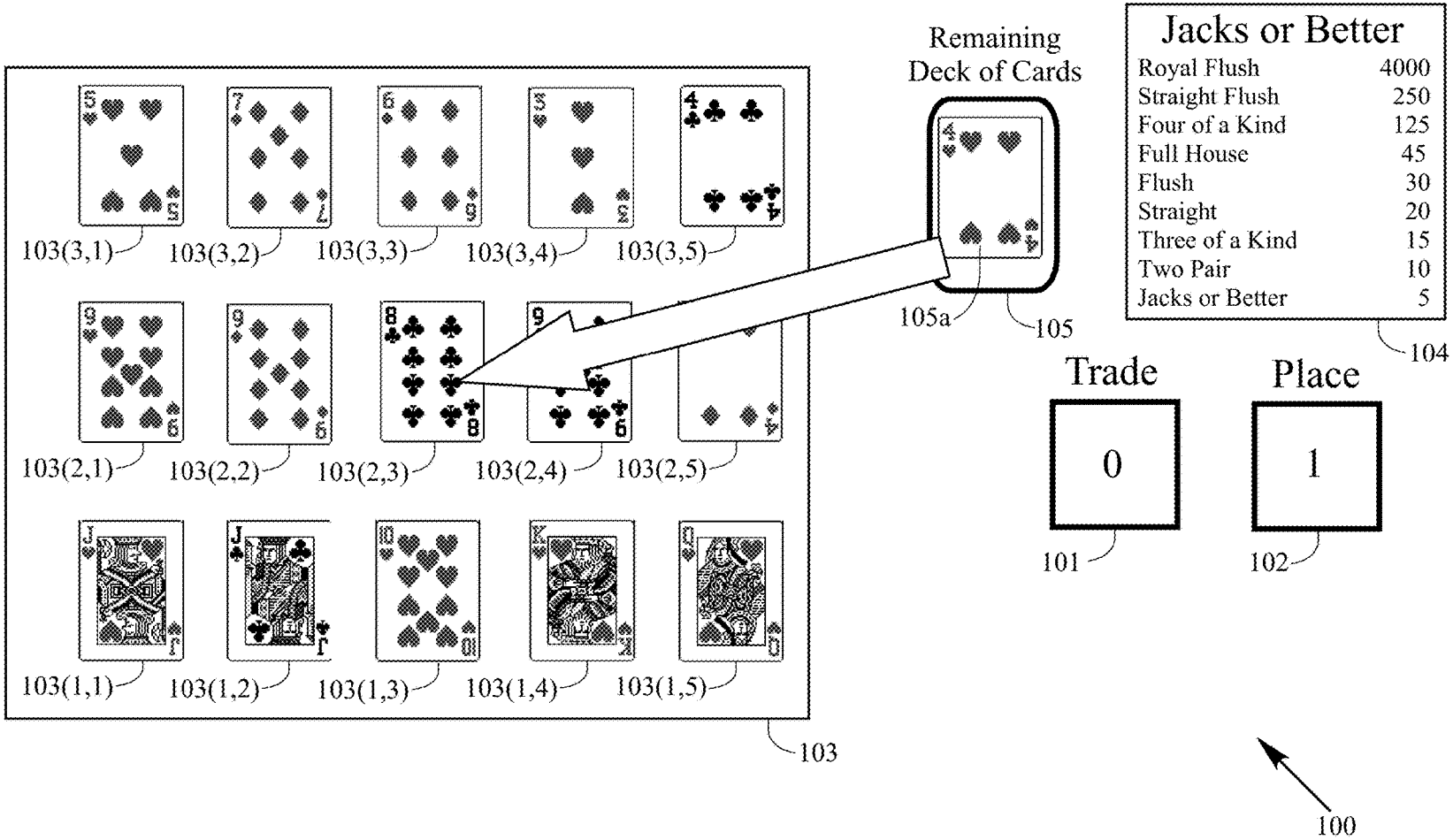
FIG. 3B shows the player drawing the next card in the deck of remaining cards, a four of hearts, and placing it in the position that is currently occupied by the eight of clubs on the three row by five column matrix.

FIG. 3B shows the active gaming area 100, trade card counter 101 (currently with a number zero in the box following the trade of king of hearts and the seven of diamonds as shown in FIG. 3.), place card box counter 102 (currently with a number one in the box to signify that the player will get one place card to place on the matrix 103 following the placement of the newly exposed card in the remaining deck of cards), dealt card matrix 103, predetermined pay scale 104, and the remaining deck of cards stack 105. FIG. 3B shows the newly exposed card, a four of hearts 105*a*, from the remaining deck of cards. The player may place this card in any of the 15 spots on the matrix 103. The player decides to place the card in the spot occupied by the eight of clubs 103(2,3). Upon placing this card on the matrix 103, the player will have one more card exposed from the remaining deck of cards in which he will place onto the matrix 103 to complete the game.

Figure 3C:
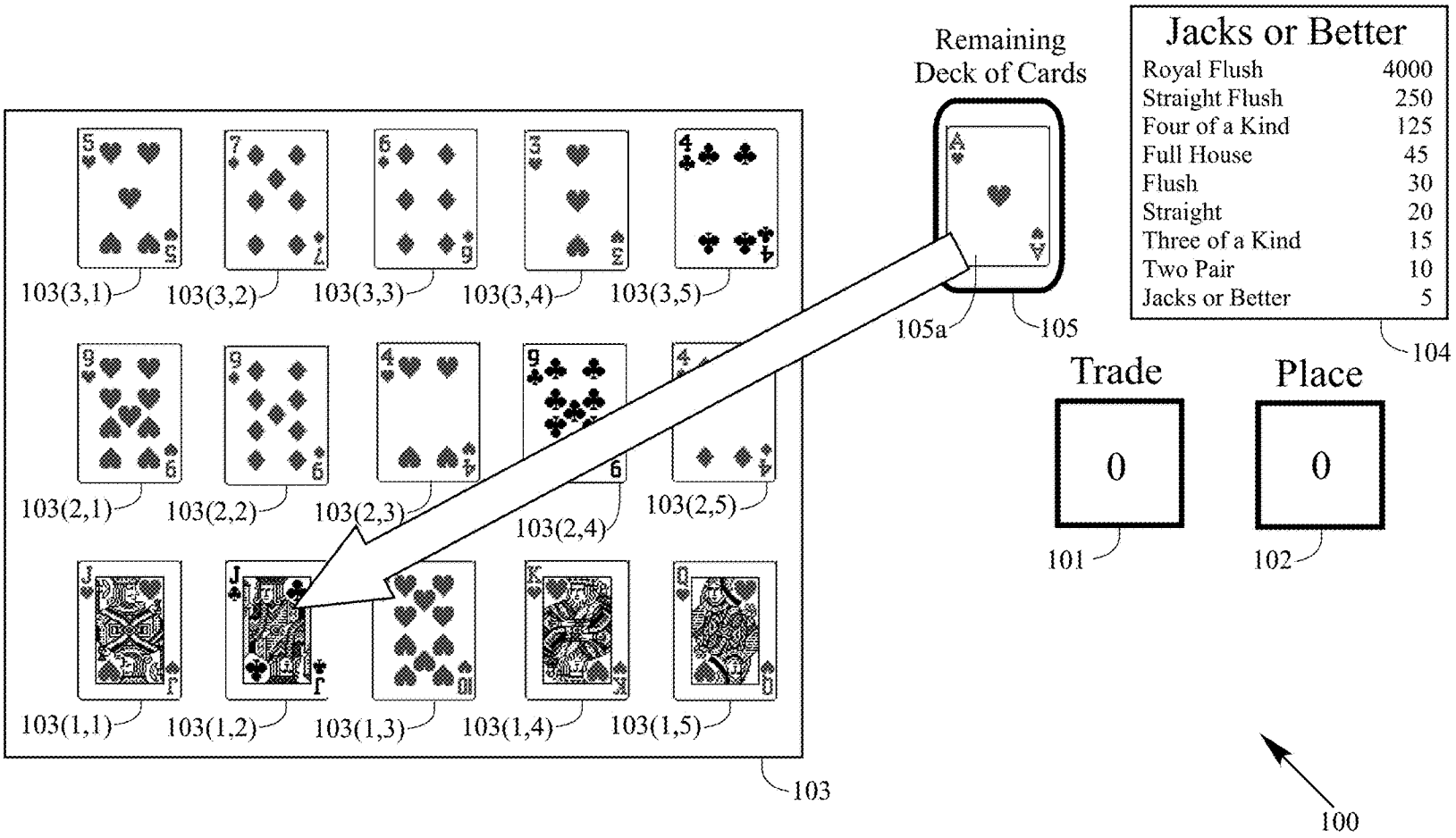
FIG. 3C shows the player drawing the next card in the deck of remaining cards, an ace of hearts, and placing it in the position that is currently occupied by the jack of clubs on the three row by five column matrix.

FIG. 3C shows the active gaming area 100, trade card counter 101 (currently with a number zero in the box following the trade of king of hearts and the seven of diamonds as shown in FIG. 3.), place card box counter 102 (currently with a number zero in the box to signify that the player is in the process of placing the final card onto the matrix 103), dealt card matrix 103, predetermined pay scale 104, and the remaining deck of cards stack 105. FIG. 3C shows the newly exposed card, an ace of hearts 105*a*, from the remaining deck of cards. The player decides to place the card in the spot occupied by the jack of clubs 103(1,2). The placing of the second card onto the matrix 103 signifies the end of the game.

Figure 3D:
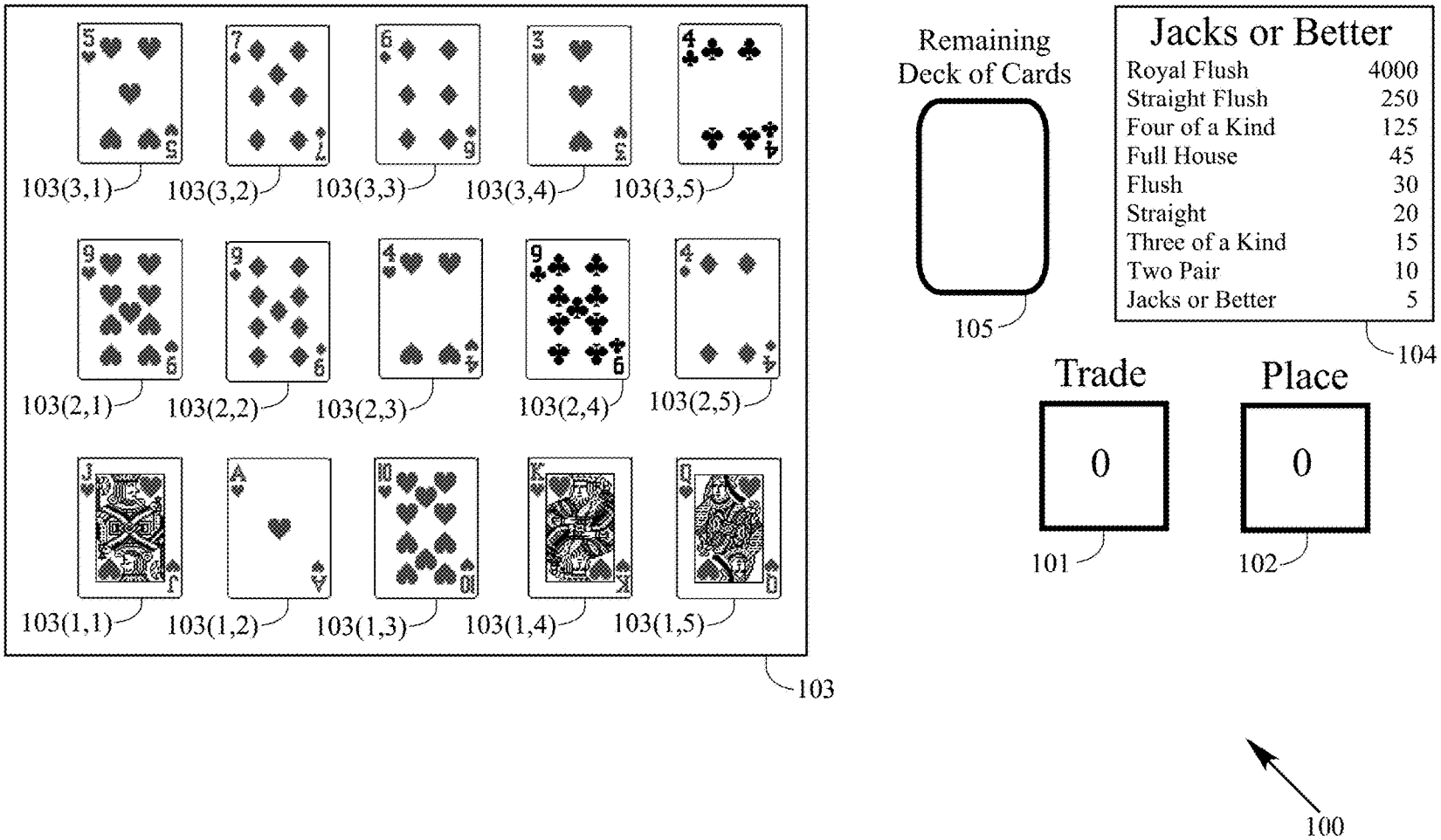
FIG. 3D shows the final outcome of the three poker hands following the initial trade and subsequent two place cards being placed on the three row by five column matrix.

FIG. 3D shows the active gaming area 100, trade card counter 101 (currently with a number zero in the box following the trade of the king of hearts and the seven of diamonds as shown in FIG. 3), place card box counter 102 (currently with a number zero in the box following the placement of the four of hearts to occupy the position in the matrix 103 originally held by the eight of clubs as shown in FIG. 3B and the final placement of the ace of hearts to occupy the position in the matrix 103 originally held by the jack of clubs as shown in FIG. 3C), dealt card matrix 103, predetermined pay scale 104, and the remaining deck of cards stack 105. FIG. 3D shows the ending hands created from playing Trade 'N Place Poker. In this embodiment, the player will be paid for each of the three horizontal five card poker hands. In other embodiments, the five vertical three card columns may pay according to a predetermined pay scale 104. The first horizontal five card hand shows the player won the hand by creating a straight (five of hearts 103(3,1), seven of diamonds 103(3,2), six of diamonds 103(3,3), three of hearts 103(3,4), and a four of clubs 103(3,5)). The player would be paid a total of 20 credits according to the predetermined pay scale 104. The second horizontal five card hand shows the player won the hand by creating a full house (nine of hearts 103(2,1), nine of diamonds 103(2,2), four of hearts 103(2,3), nine of clubs 103(2,4), and a four of diamonds 103(2,5)). The player would be paid 45 credits according to the predetermined pay scale 104. The third, and final, horizontal five card hand shows the player won the hand with a royal flush (jack of hearts 103(1,1), ace of hearts 103(1,2), ten of hearts 103(1,3), king of hearts 103(1,4), and a queen of hearts 103(1,5)). The player would be paid 4000 credits according to the predetermined pay scale 104.

In this particular embodiment, the player has three total moves. The first option is executing one trade and then placing two place cards onto the matrix 103. The second option for the current game is allowing the player to place a total of three place cards onto the matrix 103. It is possible that more than one trade card and more than three place cards may be used. The predetermined pay scale 104 may be adjusted to allow for more or less trade or place cards in a game. Additionally, a three by three card matrix, a four by four matrix, or a five by five matrix may be considered.

Figure 4:
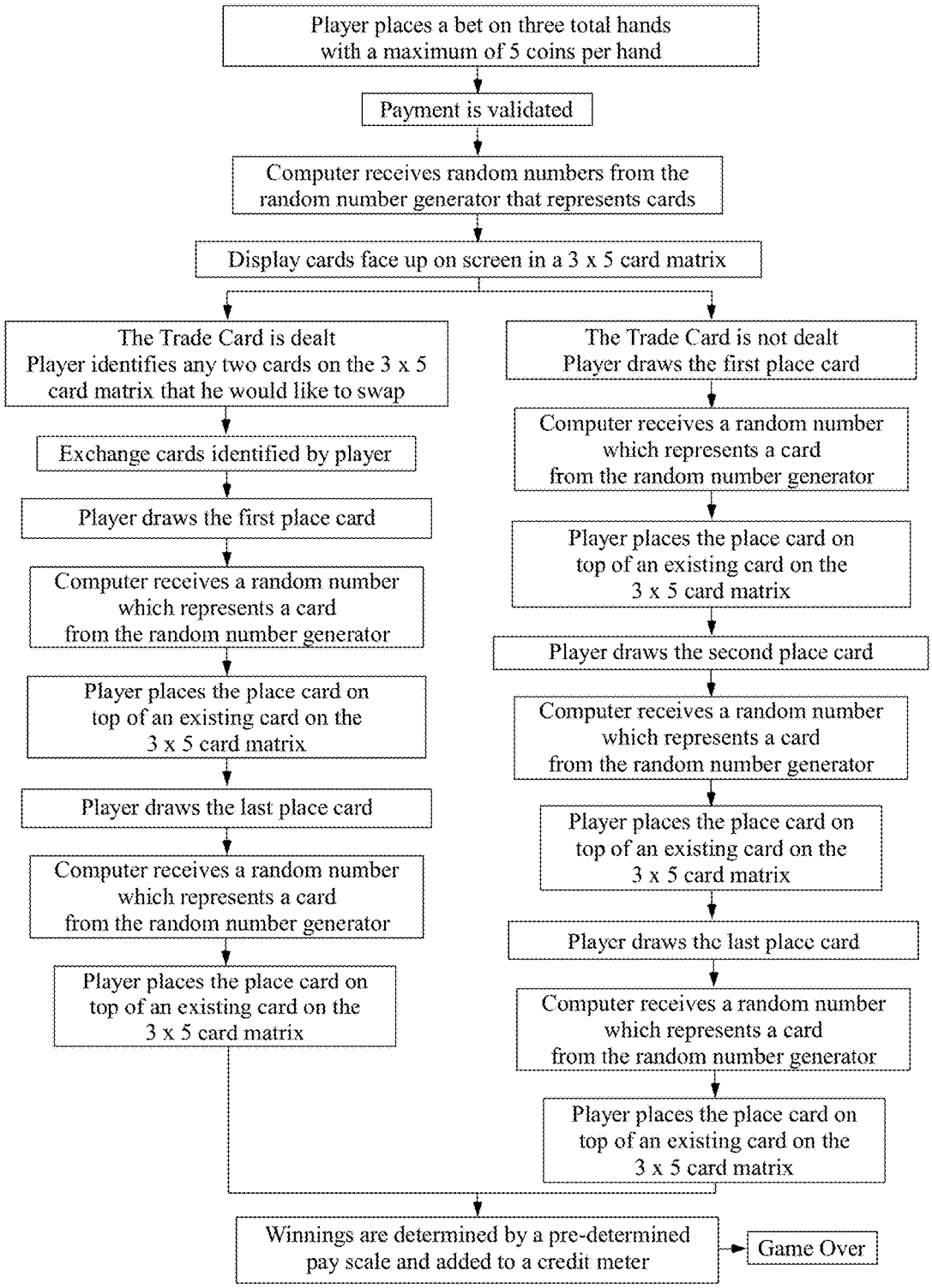
FIG. 4 shows a block diagram of the game.

FIG. 4 shows a block diagram of the game wherein there are two embodiments of the same game, one wherein a single trade card is dealt on the matrix and subsequent place cards are provided to the player and a second where no trade card is dealt on the matrix and a total of three place cards are provided to the player.

In the first embodiment, a player places a predetermined wager or bet to activate the game. The computer validates the wager and sends a signal to the random number generator to generate 15 numbers that are each represented by a playing card from the deck of 53 cards (52 cards in the standard deck plus 1 trade card.) The computer or CPU receives the random numbers and displays the representative cards on the video display in a three row by five column matrix. If a trade card is dealt in the matrix, the player identifies any two cards on the three row by five column matrix to exchange places with on the matrix. The player then uses the first of the two place cards, and the computer sends a signal to the random number generator to generate one more random number that represents a card from the remaining deck of cards. The computer receives the random number and displays the representative card on the video display, where the player then moves the card to any position in the three row by five column matrix. The player uses the second of the two place cards, and the computer sends a signal to the random number generator to generate one more random number that represents a card. The computer receives the random number and displays the representative card on the video display, where the player moves the card into any position on the three row by five column matrix. The winnings are determined by the predetermined pay scale and credits are added to the credit meter, thus ending the hand and the game.

In the second embodiment, a player places a predetermined wager or bet to activate the game. The computer validates the wager and sends a signal to the random number generator to generate 15 numbers that are each represented by a playing card from the deck of 53 cards (52 cards in the standard deck plus 1 trade card.) The computer or CPU receives the random numbers and displays the representative cards on the video display in a three row by five column matrix. A trade card is not dealt, so the player uses the first of three place cards. The computer sends a signal to the random number generator to generate a random number that represents a card from the remaining deck of cards. The computer receives the random number and displays the representative card on the video display, where the player then moves the card to any position in the three row by five column matrix. The player uses the second of the three place cards, and the computer sends a signal to the random number generator to generate one more random number that represents a card. The computer receives the random number and displays the representative card on the video display, where the player moves the card into any position on the three row by five column matrix. The player uses the third and final place card, and the computer sends a signal to the random number generator to generate one more random number that represents a card. The computer receives the random number and displays the representative card on the video display, where the player moves the card into any position on the three row by five column matrix. The winnings are determined by the predetermined pay scale and credits are added to the credit meter, thus ending the hand and the game.

Figure 5:
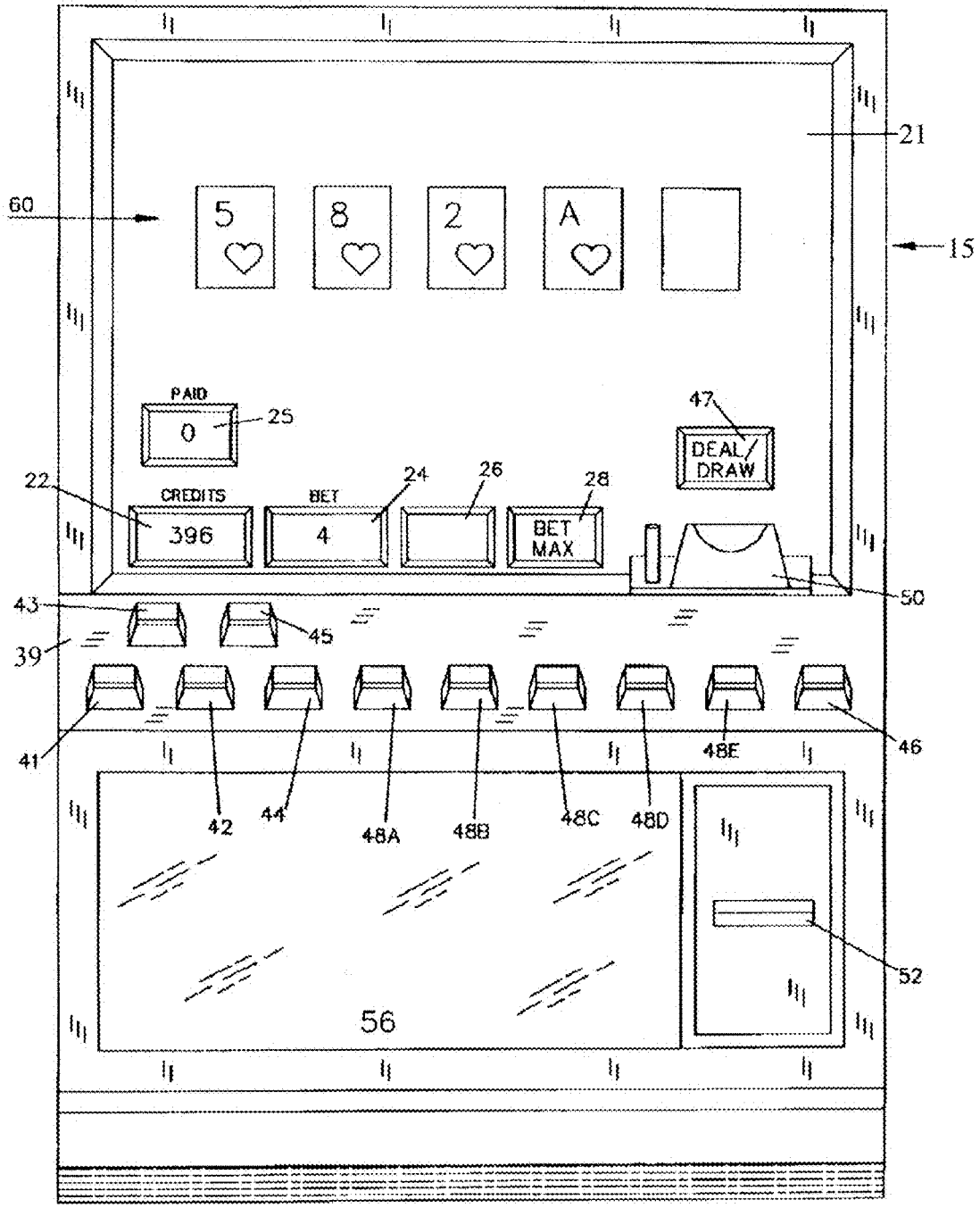
FIG. 5 shows a typical electronic video gaming machine.

FIG. 5 shows a typical electronic video gaming machine 15 that is configured to provide a player apparatus for a poker game such as the method and system of the present invention. The electronic video gaming machine 15 includes a conventional coin acceptor 50 into which the player can insert coins or gaming tokens and a bill acceptor 52 mounted to the gaming machine 15 and into which the player can insert paper currency or a ticket-in ticket-out (TITO). The use of coins, tokens, paper currency or TITO, is one mechanism by which a player may wager on the poker hands the player wishes to play. Also in the electronic video gaming machine 15, a credit meter display 22 is provided to show the amount of credits that the player has accrued on the gaming machine 15, either by inserting coins, tokens, paper currency, TITO, or from winning plays achieved by the player. Whenever the player makes a wager, the amount of the wager is subtracted from the credit meter display 22. Whenever the player achieves a winning play during the play of the game, the amount of the winning play is added to the credit meter display 22.

A conventional payout hopper is also located on the interior of the gaming machine and is used to dispense coins or tokens to the player into a payout tray 56 when the player wishes to collect any winning amounts the player has accrued. Other suitable and conventional payout mechanisms can be used, such as a ticket printer (TITO) or other cashless payout devices.

The gaming machine 15 also includes a video screen display 21 of any suitable size or type upon which representations of playing cards are displayed. In one embodiment, one or more hands can be displayed on the video screen display 21 at the same time. As illustrated in FIG. 2, a first hand is shown at location 60. Each hand would preferably have five card locations typically from left to right in a horizontal row, although other manners of displaying multiple hands including stacks of cards can be used. The video screen display 21 also contains a location at which the amount wagered on each hand is shown, for example, "Bet" 24. In this illustration, the player has bet 4 credits.

A button panel 39 is also provided on the gaming machine 15 with buttons mounted on the button panel 39 to be used by the player to control the operation of the gaming machine 15. Any suitable number or configuration of the buttons on the button panel can be used and, alternatively, conventional touch screen technology can be used for any or all of the buttons mounted on the button panel.

A typical button arrangement is shown on the button panel 39 in FIG. 2. A BET ONE button 42 is provided to allow the player to wager one credit at a time. A BET MAX button 44 is provided to allow the player to wager the maximum amount of credits permitted by the configuration of the gaming machine 15. Any number of credits can be set as the minimum or maximum amount that it is possible to wager on each hand. Typically, five credits may be the maximum number of credits for any particular hand. Alternatively, a BET ONE location 26 and a BET MAX location 28 can be provided on the video screen 21 to allow the player to wager by using conventional touch screen technology.

A conventional DEAL/DRAW button 46 is also provided on the button panel 39 which is used by the player to activate the initial deal of the cards at the deal stage of the method of play or the dealing of replacement cards at the draw stage of the method of play as is appropriate. Similarly, a DEAL/DRAW location 47 can be provided on the video screen 21 to allow the player to select either the deal step or the draw step by using conventional touch screen technology. The button panel 39 is also provided with five "CARD" buttons 48A, 48B, 48C, 48D and 48E associated with each horizontal card location on the video screen display: card button 48A is associated with the left most card location, card button 48B is associated with the second from the left card location, card button 48C is associated with the middle card location, card button 48D is associated with the second from the right card location and card button 48E is associated with the right most card location. Each card button is preferably aligned below the card locations so that the player can easily associate the appropriate card button with the appropriate card location. The method of play of the various versions of the present invention will now be described. After the player has inserted an appropriate amount of coins, tokens, paper currency, or TITO to add a sufficient amount of credits on the credit display meter 22, the player makes his initial wager. The player may press the BET ONE button 42 one or more times to bet in single increments or the player may merely press the BET MAX button 44 and the maximum number of credits are applied, for example, five credits would be wagered. The player can also use the touch screen locations to make his wager as described above.

To play the poker game, the player establishes a pool of credits, sets the wager, deals the cards, chooses which cards to hold and discard, draws replacement cards, and collects credits for winning card combinations, with enhancements.

Buttons

In one embodiment, a set of buttons are mounted on the button panel 39 and are used by the player to control the functions of the poker game: Bet One 42, Bet Max 44, Deal/Draw 46, Help 43, Pay Table 45, and Cash Out 41. Any or all of these control buttons may be displayed on the video display 21 and/or buttons electronically connected to the gaming device. If necessary, any number of buttons may be added to further facilitate control of the game, such as Hold buttons to "hold" the cards displayed on the video.

Meters

In one embodiment, meters are shown on the video display screen to display the salient information for the game: Credits meter 22, Bet meter 24, and Paid meter 25. The Credits meter 22 displays the total number credits remaining in the credit pool; the Bet meter 24 displays the amount wagered on the current, previous, and/or upcoming poker hand and is associated with the Bet One 42 and Bet Max 44 buttons; and the Paid meter 25 displays the amount of credits won on the current or previous poker hand.

Credit Pool

In one embodiment, the player deposits coins, tokens, paper currency, TITO, credit cards, debit cards, or other forms of physical and/or electronic currency into the coin acceptor slot 50 or a paper currency bill acceptor 52 to establish a pool of credits. The amount of this common pool of credits is displayed to the player on the Credit meter 22. The pool of credits increases and decreases according to the player's wins or losses and may be supplemented, if necessary, by the player by additional deposits of coins, tokens, paper currency, TITO, credit cards, debit cards, or other forms of physical and/or electronic currency.

Set the Wager

In one embodiment, the player sets the value of the wager by using the Bet One 42 and Bet Max 44 buttons. The bet may range between one credit and N-credits, with N equal to a predetermined maximum or set by the current value of the credit pool. The typical video poker gaming machine uses a five credit maximum wager.

Deck of Cards

In one embodiment, each card dealt is selected from one or more suitable decks of cards such as one or more fifty-two card traditional decks (i.e. the traditional four suits of Spades, Hearts, Diamonds, Clubs, with thirteen ranks in each suit of two, three, four, five, six, seven, eight, nine, ten, Jack, Queen, King and Ace) plus bonus cards that may be added before or after the deal or the draw. Custom decks may also be used.

Deal of Cards

In one embodiment, the player causes the machine 15 to deal the cards by pressing the Deal button 46. Once the Deal button 46 is pressed, the wager is final and non-refundable. For each deal, the machine 15 randomly displays five cards face-up in the five card positions 1, 2, 3, 4, 5. In a single standard deck embodiment, a displayed card is removed from the deck and may not be dealt again during that game. Typically, only the remaining non-dealt cards in the deck are used to replace a dealt card.

Hold and Discard

In one embodiment, the player selects which cards to hold and which cards to discard using the buttons on the machine 15 or touching the cards on the video display 21 (i.e. pressing a button or touching a card will "hold" the card) Alternatively, the machine 15 may automatically select cards to hold and/or discard and then allow the player to override the selections by using the buttons or touching the display screen 21. This may be useful in a training mode.

Winning Card Combinations

In one embodiment, the player is paid for predetermined winning combinations of cards that appear in each final hand.

SUMMARY

The foregoing description of various embodiments of the invention has been presented for purposes of illustration and description. It is not intended to be exhaustive or to limit the invention to the precise forms disclosed. Obvious modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims to be interpreted in accordance with the breadth to which they are fairly, legally, and equitably entitled.

The invention claimed is:

1. A method of operating an electronic gaming machine console for video poker, said machine including, a computer, a random number generator, a video display, and a control panel, the method comprising:

a. the placing of a wager;

b. the generation of fifteen cards in multiple poker hands randomly generated by the random number generator, said poker hands being dealt and displayed by the computer on the video display device in a matrix of three rows and five columns, one of said poker hands including a trade card;

c. the holding and discarding of cards in the poker hand and displayed on the video display device by the computer, said trade card providing for a sixteenth card randomly generated by the random number generator and displayed by the computer on the video display device to replace the trade card, said trade card allowing for the selection and trade of two cards in the three row and five column matrix to form three final poker hands.

2. The method of claim 1 wherein a seventeenth card is generated and used to replace another card in the matrix.

3. The method of claim 2 wherein an eighteenth card is generated and used to replace another card in the matrix.

* * * * *